US011434122B1

(12) United States Patent
Dos Santos

(10) Patent No.: US 11,434,122 B1
(45) **Date of Patent: *Sep. 6, 2022**

(54) DISPENSE SYSTEM FOR A FLUID MIXTURE DISPENSING DEVICE

(71) Applicant: Cana Technology, Inc., Redwood City, CA (US)

(72) Inventor: Kristopher Bernardo Dos Santos, San Francisco, CA (US)

(73) Assignee: Cana Technology, Inc., Redwood City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/548,318

(22) Filed: Dec. 10, 2021

(51) Int. Cl.
*B67D 1/00* (2006.01)

(52) U.S. Cl.
CPC ..... *B67D 1/0051* (2013.01); *B67D 1/0016* (2013.01); *B67D 1/0085* (2013.01)

(58) Field of Classification Search
CPC .. B67D 1/0016; B67D 1/0085; B67D 1/0015; B67D 1/0019; B67D 1/0037; B67D 1/0044; B67D 1/0046; B67D 1/0885; B67D 1/0888; B67D 1/1234; B67D 2001/0093; B67D 2001/0095; B67D 3/0019
See application file for complete search history.

(56) References Cited

U.S. PATENT DOCUMENTS 2,380,884 A * 7/1945 Osborne ..... G07F 13/02 222/64
2,808,965 A * 10/1957 Graphia, III ..... B67D 3/00 222/183
4,651,862 A * 3/1987 Greenfield, Jr. ..... B67D 1/1297 222/2
5,222,631 A * 6/1993 Hood ..... B67D 1/0835 222/537
5,234,134 A * 8/1993 Raab ..... B67D 1/0079 222/321.7
5,566,732 A * 10/1996 Nelson ..... B67D 1/1236 141/351

(Continued)

FOREIGN PATENT DOCUMENTS

WO 1996001225 A1 1/1996
WO 2009020256 A1 2/2009
WO 2018064454 A1 4/2018

OTHER PUBLICATIONS

Restriction Requirement dated Apr. 15, 2022 from U.S. Appl. No. 17/548,934, 6 pages.

*Primary Examiner* — Frederick C Nicolas
*Assistant Examiner* — Randall A Gruby
(74) *Attorney, Agent, or Firm* — Daylight Law, P.C.

(57) ABSTRACT

Reservoirs for fluid mixture dispensing devices, and fluid mixture devices adapted to include such reservoirs are disclosed. One disclosed fluid mixture dispensing device includes a controller programmed to actuate a set of valves and at least one pump to dispense a fluid mixture, having a final dispense volume, from the fluid mixture dispensing device. The fluid mixture dispensing device also includes a reservoir with a chamber with at least one inlet for receiving a liquid ingredient, a bottom of the chamber, which is continuously sloped towards a lowest point of the chamber, and a spout at the lowest point of the chamber. The chamber is shaped so that when the fluid mixture is in the chamber the fluid mixture flows laminarly out of the spout.

23 Claims, 8 Drawing Sheets

(56) References Cited

U.S. PATENT DOCUMENTS 6,230,767 B1 * 5/2001 Nelson ..... B67C 3/2608 141/264
6,234,222 B1 * 5/2001 Nelson ..... B67D 1/1411 141/2
6,234,223 B1 * 5/2001 Nelson ..... B67D 1/1405 141/2
6,237,652 B1 * 5/2001 Nelson ..... B67C 3/2608 141/2
6,530,400 B2 * 3/2003 Nelson ..... B67D 1/1422 141/2
6,779,685 B2 * 8/2004 Nelson ..... B67D 1/0406 222/402.1
6,892,401 B1 * 5/2005 Mangum ..... E03C 1/308 4/255.06
7,004,355 B1 * 2/2006 Crisp, III ..... B67D 1/0052 222/399
7,648,049 B1 * 1/2010 Lassota ..... B01F 27/90 222/145.6
8,376,189 B2 * 2/2013 Py ..... F16K 15/142 141/90
8,788,090 B2 7/2014 Rothschild
8,998,035 B2 * 4/2015 Ford ..... B67D 1/1231 222/1
9,399,570 B2 7/2016 Haperen et al.
10,294,094 B2 5/2019 Mottaz et al.
10,506,820 B2 * 12/2019 Fisher ..... A23G 9/28
2003/0056285 A1 3/2003 Pollastri et al.
2004/0194717 A1 10/2004 Holyoak
2004/0222395 A1 * 11/2004 Yee ..... F25B 41/345 251/65
2007/0212468 A1 9/2007 White et al.
2009/0257303 A1 10/2009 Rayner et al.
2010/0108723 A1 * 5/2010 Chassaing ..... F16K 31/0658 222/571
2012/0046785 A1 2/2012 Deo et al.
2012/0055953 A1 * 3/2012 Shiotani ..... B67D 3/0009 222/105
2015/0298956 A1 10/2015 Rudick et al.
2018/0344570 A1 12/2018 Davis et al.
2020/0346914 A1 11/2020 Aslam et al.

* cited by examiner

DISPENSE SYSTEM FOR A FLUID MIXTURE DISPENSING DEVICE

BACKGROUND

Fluid dispensing devices are widely used for various purposes, for example in the food and beverages industry. Some types of fluid dispensing devices are designed to dispense a single fluid, while others can dispense more than one fluid out of a single or multiple outlets. The fluids can be held in containers in the device, as it is the case for some fountain drink systems that use bag-in-box containers. Some fluid dispensing devices can be further designed not only to dispense a fluid but also to mix a set of ingredients to create a fluid mixture. Some fountain drink systems implement this design where soft drink syrup containers are connected to the dispenser and mixed with water to create a beverage.

Dispense mechanisms used by the fluid dispensing devices of the prior art include gravity-based mechanisms. In those mechanisms, a valve is used to prevent and allow dispense of the fluid, so that when the valve is opened, the fluid can be released by the natural effect of gravity, without the use of any external force. Controlling a dispense flow in those situations can be challenging because the number of external factors that can be calibrated is limited. The lack of an external expulsion force may result in residues from the beverage not flowing out of the device, which can cross contaminate subsequent drinks. Furthermore, the lack of control over the fluid flow can result in unwanted conditions such as random spraying or splashing.

SUMMARY

This disclosure relates generally to fluid mixture dispensing devices and methods, and more specifically, to dispense systems for fluid mixture dispensing devices.

The fluid mixture dispensing device of specific embodiments of the invention may be configured to dispense a fluid mixture created from at least one ingredient stored in an ingredient reservoir of the device and/or at least one solvent stored in a solvent reservoir of the device. The ingredient(s) and/or solvent(s) can be received by a final dispense reservoir of the device from where the fluid mixture can be dispensed out of the device.

The final dispense reservoir can include at least one fluid inlet to receive the ingredient(s) and/or solvent(s) and at least one fluid outlet to dispense the fluid mixture out of the device. In specific embodiments of the invention, the final dispense reservoir has a continuously sloped bottom which is sloped towards a lowest point of the reservoir. In those embodiments, the fluid outlet can be a spout in the lowest point of the chamber. In specific embodiments of the invention, the spout can be sealed by an actuating sealing mechanism which seals the spout when the ingredient(s) and/or solvent(s) are being dispensed into the final dispense reservoir and unseals the spout to release the fluid mixture from the reservoir.

The design considerations of both the sloped bottom of the final dispense reservoir and the spout can contribute to the characterization of the fluid flow from the final dispense reservoir to the exterior of the device. Final dispense reservoirs in accordance with specific embodiments of the invention disclosed herein can provide significant advantages in that they minimize fluid carryover from one fluid mixture to the next and/or assure a laminar flow of the fluid mixture from the outlet of the final dispense reservoir.

In specific embodiments of the invention, a reservoir fora fluid mixture dispensing device is provided. The reservoir comprises a chamber with at least one inlet for receiving a liquid ingredient, a bottom of the chamber, wherein the bottom is continuously sloped towards a lowest point of the chamber, and a spout at the lowest point of the chamber having a diameter of less than 10 mm. The chamber is shaped so that when a liquid volume in the chamber is 150 ml, a liquid height in the chamber is less than 45 mm.

In specific embodiments of the invention, a fluid mixture dispensing device is provided. The device comprises a controller programmed to actuate a set of valves and at least one pump to dispense a fluid mixture, having a final dispense volume, from the fluid mixture dispensing device. The device further comprises a reservoir. The reservoir comprises a chamber with at least one inlet for receiving a liquid ingredient of the fluid mixture, a bottom of the chamber, wherein the bottom is continuously sloped towards a lowest point of the chamber, and a spout at the lowest point of the chamber having a diameter of less than 10 mm. The chamber is shaped so that when the fluid mixture having the final dispense volume is in the chamber a liquid height of the fluid mixture in the chamber is less than 45 mm.

In specific embodiments of the invention, a reservoir fora fluid mixture dispensing device is provided. The reservoir comprises a chamber with at least one inlet for receiving a liquid ingredient, a bottom of the chamber, wherein the bottom is continuously sloped towards a lowest point of the chamber, and a spout at the lowest point of the chamber. The chamber is shaped so that room temperature liquid water would flow laminarly out of the spout when a liquid volume in the chamber is: (i) a maximum volume capacity of the chamber; or (ii) 400 ml, whichever is smaller.

BRIEF DESCRIPTION OF THE DRAWINGS

In the Figures, like reference numbers correspond to like components unless otherwise stated.

DETAILED DESCRIPTION

Reference will now be made in detail to implementations and embodiments of various aspects and variations of systems and methods described herein. Although several exemplary variations of the systems and methods are described herein, other variations of the systems and methods may include aspects of the systems and methods described herein combined in any suitable manner having combinations of all or some of the aspects described.

Different components and methods for a fluid mixture dispensing device will be described in detail in this disclosure. The methods and systems disclosed in this section are nonlimiting embodiments of the invention, are provided for explanatory purposes only, and should not be used to constrict the full scope of the invention. It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

Figure 1A:
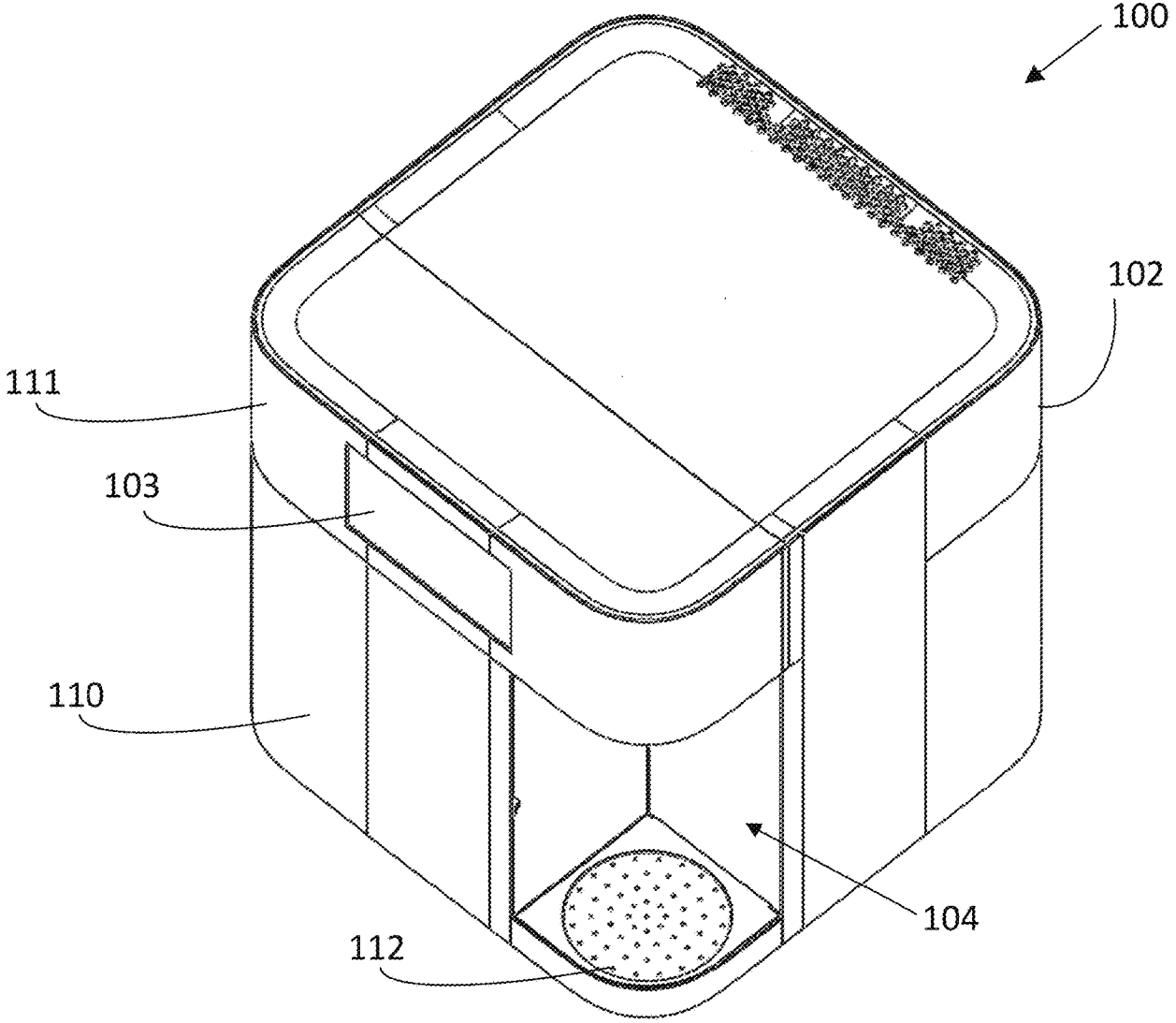
FIG. 1A illustrates an example of a fluid mixture dispensing device, in accordance with specific embodiments disclosed herein.

FIG. 1A illustrates an example of a fluid mixture dispensing device 100, in accordance with specific embodiments disclosed herein. The fluid mixture dispensing device 100 can be any of the fluid mixture dispensing devices described in U.S. Provisional Patent Application No. 63/146,461 filed Feb. 5, 2021 and U.S. patent application Ser. No. 17/547,081 filed Dec. 9, 2021, all of which are incorporated by reference herein in their entirety for all purposes.

The fluid mixture dispensing device 100 can include a casing, such as casing 102, that can house various internal components of the device. The casing 102 can include various accesses to the interior of the device. The accesses can be in the form of doors, such as upper access door 111 and lower access door 110. The accesses can also be removable portions, such as lids or walls of the casing. The accesses can be configured so that a user of the device can access at least part of the interior of the device, for example to replace a component, to clean the device, etc., as will be described below in more detail.

The fluid mixture dispensing device can also include a user interface, such as user interface 103. The user interface 103 can include any means for outputting information from the device to a user of the device, and for inputting information from the user of the device to the device. In this way, the user interface can include any means that facilitate the interaction of a user of the device with the device, including but not limited to a display, a speaker, a microphone, a camera, various sensors such as light and presence sensors, etc. For example, the user interface can include a touch screen display, so that the device can display information for the user via the display, and the user can provide inputs to the device via the touch screen display. As another example, the interaction between the user and the device can be via auditory cues provided by the device via a speaker and voice commands from the user received via a microphone. As another example, the device can recognize user facial expressions and gestures via cameras and sensors. The user interface components can be associated to a controller of the device so that the controller can administrate the information to be outputted and process the information being received.

The fluid mixture dispensing device 100 can also include a dispense area, such as dispense area 104. Dispense area 104 can be the area where a fluid mixture is dispensed out of the device 100. Dispense area 104 can be an area configured to receive a vessel or other containers to dispense a fluid mixture out of device 100. The dispense area 104 can be sized so that different containers (for example a wine glass) can be placed therein. In specific embodiments of the invention, the dispense area 104 can be adjusted, for example by using a height adjustable tray. The dispense area 104 can include a waste outlet, such as waste outlet 112. The waste outlet can be a removable waste outlet, such as a removable drip tray.

Figure 1B:
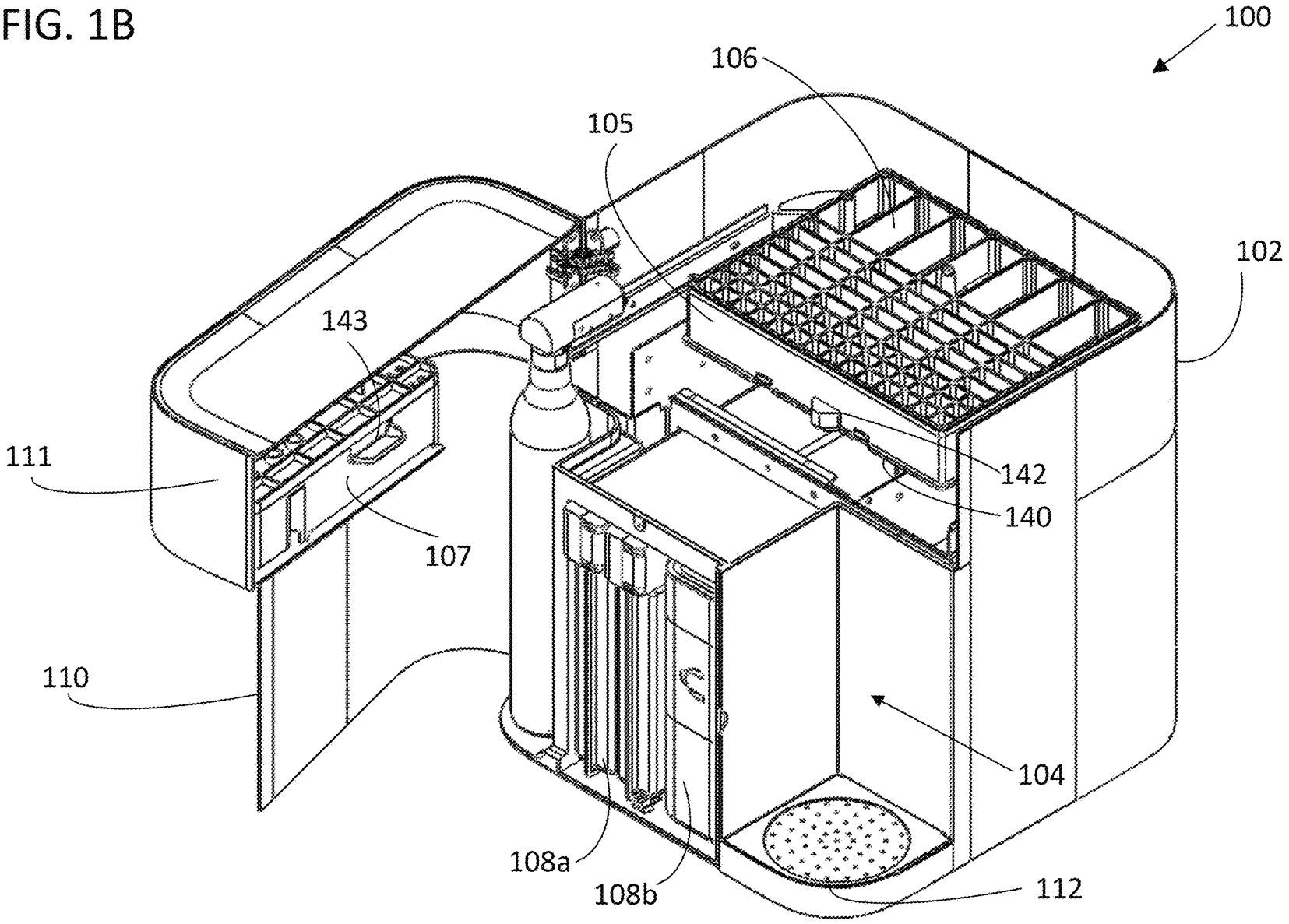
FIG. 1B illustrates exemplary internal components of a fluid mixture dispensing device, in accordance with specific embodiments disclosed herein.

FIG. 1B illustrates the fluid mixture dispensing device 100 of FIG. 1A in an open configuration to illustrate exemplary internal components that can be housed by the casing 102 of the fluid mixture dispensing device 100, in accordance with specific embodiments disclosed herein. The accesses, such as upper access door 111 and the lower access door 110, are open in this figure. The doors can be attached to the remaining of the casing via hinges or other structure. The doors can alternatively be removable doors so that they are completely removed when open. The doors can be any kind of doors such as sliding doors, and open in any direction, for example to the top or to the right of the device. Doors 111 and 110 can be separate doors or a unitary door of the device. In this example, the access doors have been represented in the front wall of the device. However, this is not a limitation of the invention. Different doors and/or any access to the interior of the device can be located anywhere on the device, and do not need to be located on the front wall. In the example of FIG. 1B, a portion of the top wall of the device 100 has been removed to expose some additional exemplary components of the device.

The fluid mixture dispensing device 100 can include one or more ingredient reservoirs, such as ingredient reservoir 106. The ingredient reservoirs can store ingredients to be used by the fluid mixture dispensing device 100 to create a fluid mixture, such as concentrated liquids (e.g., flavor syrups, salts, acids, etc.). The ingredient reservoirs can be any of the ingredient reservoirs described in U.S. Provisional Patent Application No. 63/146,461 filed Feb. 5, 2021, U.S. patent application Ser. No. 17/547,081 filed Dec. 9, 2021 and U.S. patent application Ser. No. 17/545,699 filed Dec. 8, 2021, all of which are incorporated by reference herein in their entirety for all purposes.

The ingredient reservoirs, such as ingredient reservoir 106, can be located in a cartridge, such as cartridge 105. The cartridge can be accessed via one of the accesses of the device. For example, the cartridge can be accessed through upper access door 111. In this way, a user of the device can replace the cartridge as needed. In the example of FIG. 1B, the top surface of cartridge 105 has been removed to expose the ingredient reservoirs 106. However, the cartridge can be completely encased. In specific embodiments of the invention, the cartridge includes a removable lid so that the various ingredient reservoirs can be accessed, for example to be refilled. The cartridge can be any of the cartridges described in U.S. Provisional Patent Application No. 63/146,461 filed Feb. 5, 2021, U.S. patent application Ser. No. 17/547,081 filed Dec. 9, 2021, U.S. patent application Ser. No. 17/547,612 filed Dec. 10, 2021 and U.S. patent application Ser. No. 17/545,699 filed Dec. 8, 2021, all of which are incorporated by reference herein in their entirety for all purposes.

The fluid mixture dispensing device 100 can also include one or more solvent reservoirs, such as solvent reservoirs 108*a* and 108*b*. The solvent reservoirs can store solvents to be used by the fluid mixture dispensing device 100 to create a fluid mixture, such as water, alcohol, etc. The solvent reservoirs can be any of the solvent reservoirs described in U.S. Provisional Patent Application No. 63/146,461 filed Feb. 5, 2021 and U.S. patent application Ser. No. 17/547,081 filed Dec. 9, 2021, all of which are incorporated by reference herein in their entirety for all purposes. The solvent reservoirs can be accessed via one of the accesses of the device. For example, the solvent reservoirs can be accessed through lower access door 110. In this way, a user of the device can remove the solvent reservoirs as needed, for example to refill a water tank.

The fluid mixture dispensing device 100 can be configured to create a fluid mixture by mixing one or more ingredients from one or more ingredient reservoirs 106 and/or one or more solvents from one or more solvent reservoirs 108*a* and 108*b*. A controller of the system can have knowledge of the amount of each ingredient and/or solvent needed for a given recipe and cause the device to dispense the required amount of ingredient and/or solvent to a mixing area of the device. The mixing area can be formed on a bottom plate, such as plate 140, of the ingredient cartridge. Ingredients from the ingredient reservoirs 106 and solvent from the solvent reservoirs 108*a* and 108*b* can flow from the respective reservoirs to the mixing area of the device 100. In specific embodiments of the invention, the ingredients from the ingredient reservoirs 106 flow to the mixing area and solvent from the solvent reservoirs 108*a* and 108*b* flow though the mixing area to "collect" the ingredients dispensed therein. In specific embodiments of the invention, solvent from the solvent reservoirs 108*a* and 108*b* is allowed to enter the mixing area, and the ingredients from the ingredient reservoirs are dispensed from the reservoirs directly into the solvent already in the mixing area. In any case, an intermediate mixture of one or more ingredients and/or one or more solvent can be formed in the mixing area of the device.

The term "intermediate mixture" is used herein to refer to a mixture being created in the mixing area of the device (for example in one or more mixing channels formed on plate 140) that is yet to be dispensed out of the mixing area and to a final dispense reservoir of the device. FIG. 1B illustrates a fluid outlet 142 of the cartridge. Fluid outlet 142 can be connected to the mixing area and allow the intermediate mixture formed therein to flow out to a final dispense reservoir 107. The final dispense reservoir can be any of the mixing chambers described in U.S. Provisional Patent Application No. 63/146,461 filed Feb. 5, 2021, which is incorporated by reference herein in its entirety for all purposes.

When the access door 111 is closed, the final dispense reservoir 107 can be connected to the fluid outlet 142 of the cartridge via the fluid inlet 143. The ingredient(s) and/or solvent(s) that form the intermediate mixture can then enter the final dispense reservoir 107. Via the inlet 143. Once in the final dispense reservoir 107, the intermediate mixture can be turned into the final fluid mixture to be dispensed by the device 100. In specific embodiments of the invention, the final fluid mixture is the intermediate mixture itself, as received from the mixing area. Alternatively, or in combination, the one or more ingredients and/or solvent(s) can flow from the mixing area to the final dispense reservoir 107 so that they are mixed as they flow into the final dispense reservoir to form the final fluid mixture. In specific embodiments of the invention, the final dispense reservoir is shaped so that the ingredient(s) and/or solvent(s) can be passively mixed as they flow into the mixing area. Alternatively, or in combination, the intermediate mixture can be further mixed with other ingredients (for example sugar water, carbonated water, etc.) in the final dispense reservoir to create the final fluid mixture. Alternatively, or in combination, the intermediate mixture can be submitted to other processes such as active mixing, temperature adjustments, carbonation, etc. in the final dispense reservoir 107 to create the final fluid mixture. The final fluid mixture can then be dispensed out the final dispense reservoir 107 and to the dispense area 104 via an outlet of the final dispense reservoir, as will be described in more detail in this disclosure.

In any case, the final dispense reservoir 107 can be configured to receive the ingredient(s) and or solvent(s) required for a given fluid mixture and hold the fluid mixture therein if needed (for example until all the components of the fluid mixture have been received and/or any mixing or other process has been performed). The final dispense reservoir can then be configured to dispense the fluid mixture out of the device and to a dispense area 104.

Since a device such as fluid mixture dispensing device 100 can be operated to produce a plurality of different fluid mixtures (comprising any different combination of ingredient(s) and/or solvent(s)), in specific embodiments of the invention it can be advantageous to provide a final dispense reservoir which minimizes residues carryover from one fluid mixture to the next. Specially for situations in which subsequent fluid mixtures include different components than the previous fluid mixture dispensed by the device, left-overs from the previous fluid mixture can contaminate the subsequent one. This situation can be not only undesirable but also dangerous, for example in a case where a controlled substance such as alcohol, or a potential allergen, was used in a fluid mixture for a previous user but should not be consumed by the next user. Even if a cleaning cycle is performed in between fluid mixtures, minimizing carryover is still important not only to reduce the workload during the cleaning cycle but also to avoid any residues and/or waste from the cleaning cycle itself remaining in the final dispense reservoir. Minimizing carryover can be also advantageous, even if the device is used for the same type of fluid mixture, for example because it can be guaranteed that an optimal amount of required fluid mixture will be dispensed to the dispense area and that no residual components from a prior fluid mixture will serve as a catalyst for bacterial growth.

Since a device such as fluid mixture dispensing device 100 can be operated to dispense a fluid mixture out of the device (for example to a container placed on dispense area 104), in specific embodiments of the invention it can be advantageous to provide a laminar flow out of the final dispense reservoir 107 and to the dispense area 104. In this way, the fluid mixture can be dispensed out of the final dispense reservoir in a controlled and constant flow and splashing and other undesirable conditions that may arise from a turbulent flow can be avoided.

Figure 2A:
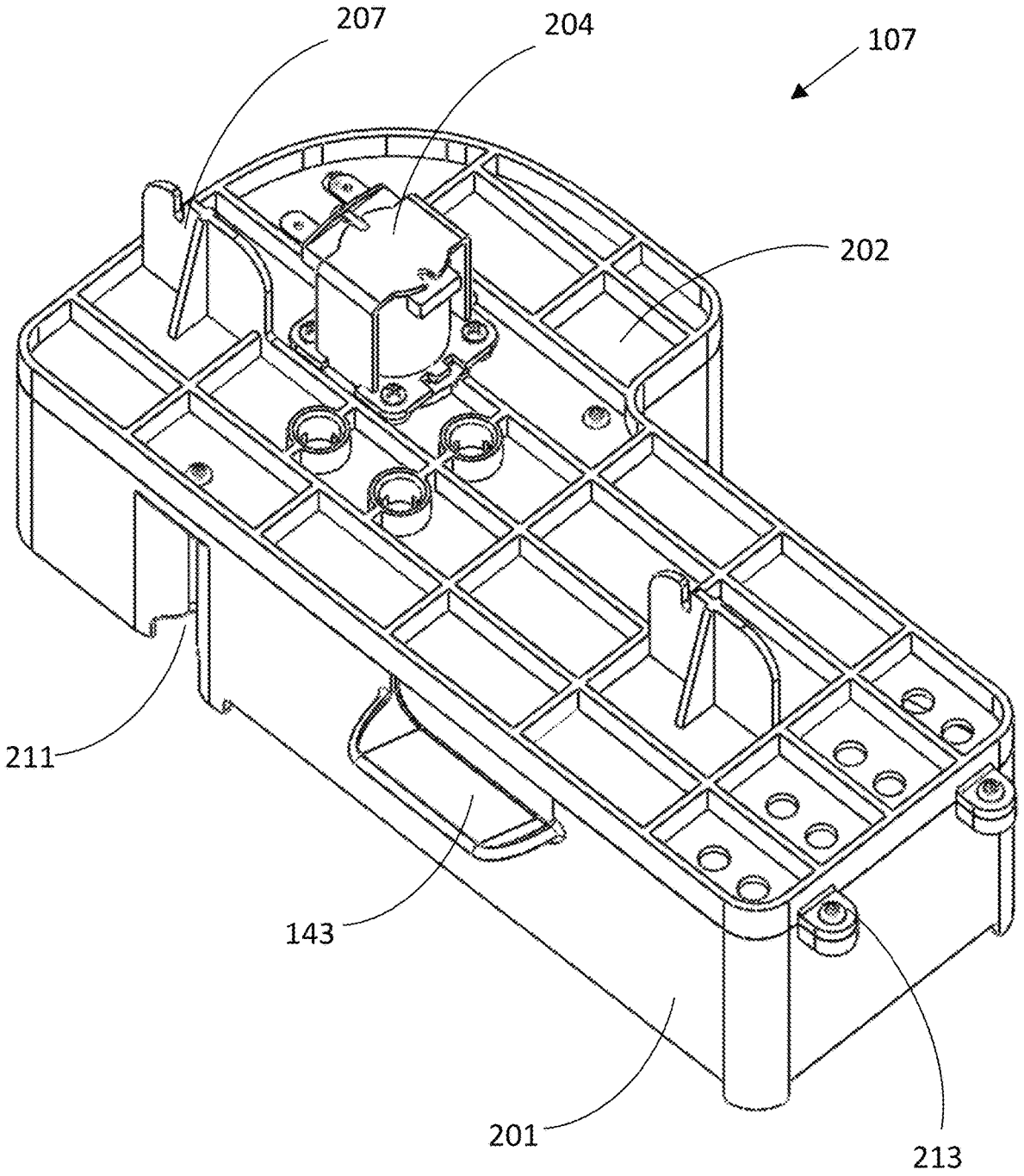
FIG. 2A illustrates an example of a final dispense reservoir, in accordance with specific embodiments disclosed herein.
Figure 2B:
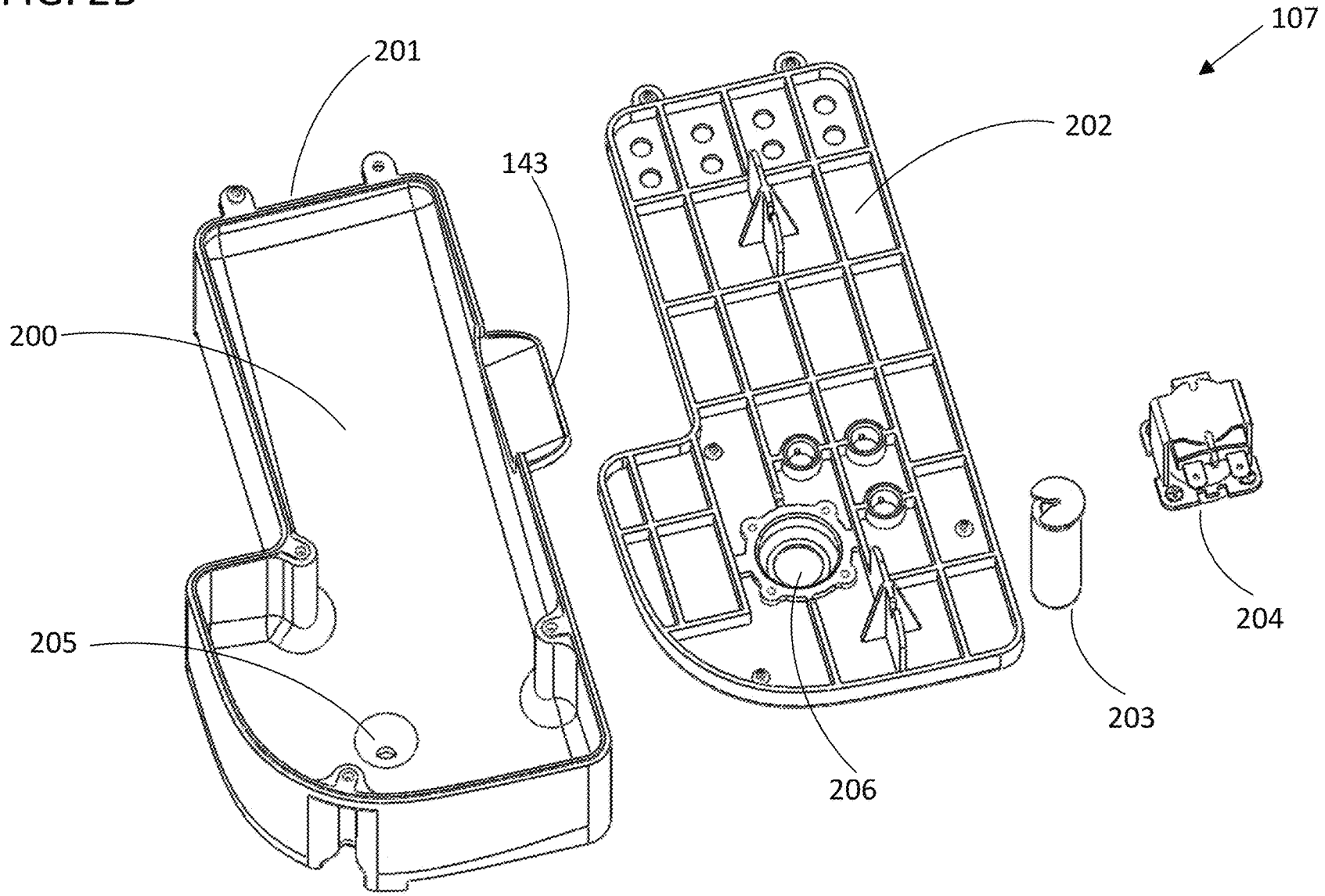
FIG. 2B illustrates an exploded view of the final dispense reservoir of FIG. 2A, in accordance with specific embodiments disclosed herein.
Figure 2C:
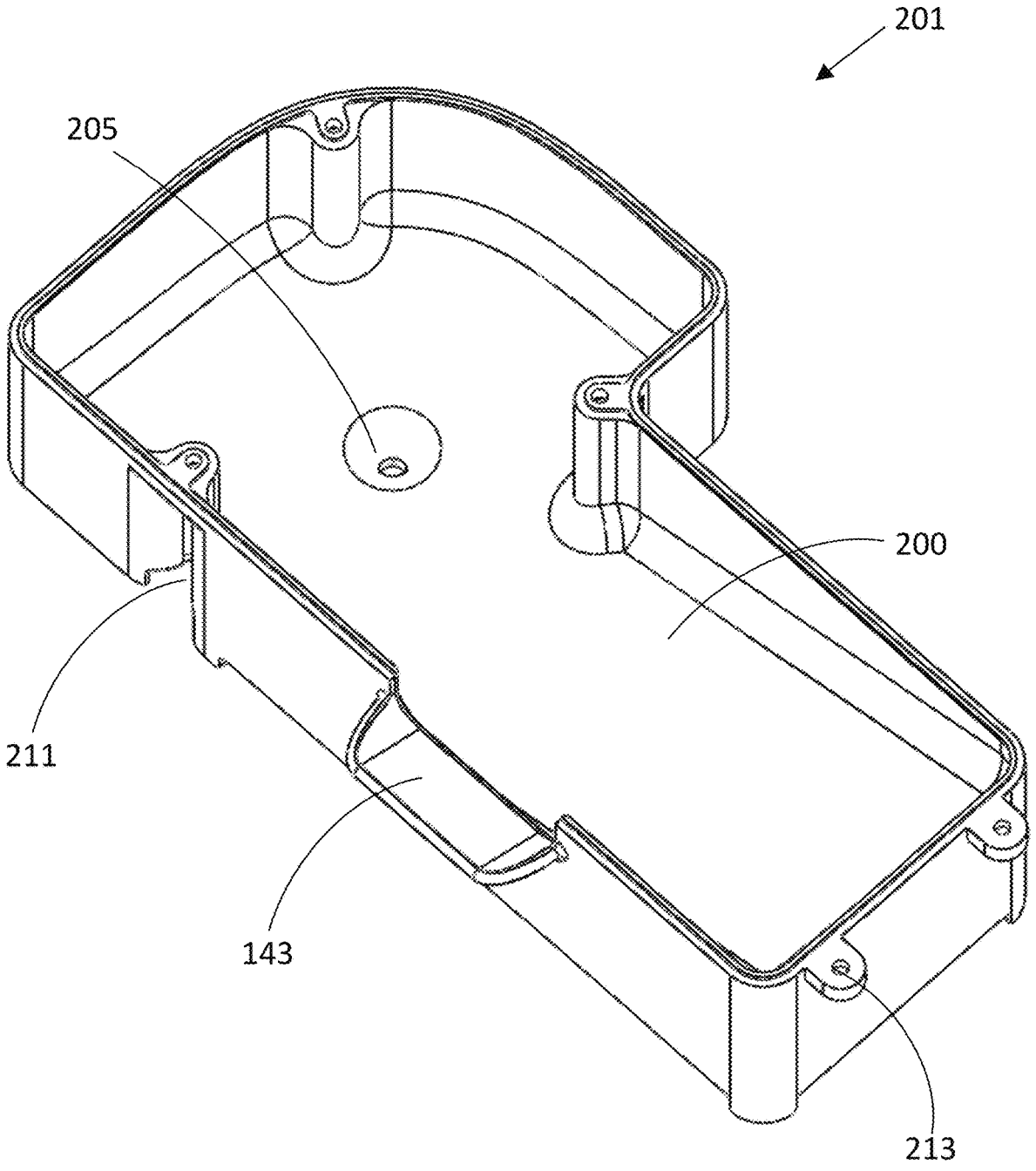
FIG. 2C illustrates a perspective view of an exemplary implementation of a chamber of the final dispense reservoir of FIG. 2A, in accordance with specific embodiments disclosed herein.

In specific embodiments of the invention, the final dispense reservoir, such as final dispense reservoir 107, can be designed to minimize carryover. In specific embodiments of the invention, the final dispense reservoir 107 can also (or alternatively) be designed to produce a laminar flow out of the device 100. FIG. 2A illustrates an example of a final dispense reservoir (such as final dispense reservoir 107), in accordance with specific embodiments of the invention disclosed herein. FIG. 2B illustrates an exploded view of the final dispense reservoir of FIG. 2A where more details can be appreciated. FIG. 2C illustrates a perspective view of an exemplary implementation of a chamber of the final dispense reservoir of FIG. 2A, where further details can be appreciated.

As illustrated in FIGS. 2A, 2B, and 2C, the final dispense reservoir 107 can include a chamber 201. The chamber 201 can include an inlet, such as inlet 143, for receiving the components of the fluid mixture, for example one or more ingredients from ingredient reservoirs 106 and/or one or more solvents from solvent reservoirs 108*a* and 108*b*. The components can include liquid components such as liquid ingredients and solvents so that a liquid volume is formed in the chamber 201. The chamber 201 can also include an outlet, such as a spout 205 illustrated in FIG. 2B, for dispensing the fluid mixture out of the chamber 201, and for example to a dispense area 104 of the device.

As also illustrated in FIGS. 2A and 2B, the final dispense reservoir 107 can include a lid 202. In specific embodiments of the invention, the lid 202 can be detachably attached to the chamber 201. In specific embodiments of the invention, the chamber 201 is detachably attached to the device 100 via the lid 202. For example, the lid 202 can be permanently attached to the device, and the chamber 201 can be configured to detach from the lid to be detached from the device. In this way, the chamber can be detached for example to be cleaned. In specific embodiments of the invention, the lid 202 is also detachably attached to the device and can also be removed from the device. In specific embodiments of the invention, at least part of the reservoir 107 (for example the chamber 201 and/or lid 202) can be dishwasher safe and can be removed to be placed in the dishwasher for cleaning.

In specific embodiments of the invention, the final dispense reservoir 107 is detachably attached to the device 100, so that a user of the device may be able to remove at least part of the reservoir from the device. As illustrated in FIG. 2A, the reservoir 107 can include various attachment means such as recesses 211 and/or screw tabs 213, which can serve to attach the reservoir 107 to the device and/or the lid 202 to the chamber 201. The reservoir can include attachment means such as screws, snaps, etc., to be attached to the device 100.

The reservoir can be removed from the device for example by opening one of the access doors of the device, such as door 111. In the example illustrated in FIG. 1B, the final dispense reservoir is conveniently installed in a door of the device. However, this is not a limitation of the invention. The reservoir can be installed anywhere in the device as long as it allows the fluid mixture to be formed therein and be dispensed out of the device.

The final dispense reservoir 107 can also include a sealing mechanism for the spout 205, such as sealing mechanism 203 illustrated in FIG. 2B. In this way, the chamber 201 can be sealed (by sealing the spout) for example to receive the components of a fluid mixture to be dispensed, and unsealed, (be unsealing the spout) to dispense the fluid mixture out of the chamber. In specific embodiments of the invention, the sealing mechanism 203 includes a stopper that can be upwardly actuated to alternatively seal and unsealed the spout. In specific embodiments of the invention, the sealing mechanism 203 is attached to the lid 202 of the chamber. The sealing mechanism 203 can be attached to the lid 202 via an attachment assembly 204 of the sealing mechanism. In specific embodiments of the invention, the attachment assembly 204 can include an actuator for the sealing mechanism 203. For example, the attachment assembly 204 can include an electromechanical actuator, such as a solenoid, to actuate the sealing mechanism. In this way, the sealing mechanism 203 can be attached to the lid 202 of the reservoir via the electromechanical valve, and the sealing mechanism 203 can be the plunger of the electromechanical valve. As illustrated, the sealing mechanism 203 and/or attachment assembly 204 can be detachably attached to the lid 202 of the device.

In specific embodiments of the invention, the lid 202 can include holding means, such as tab 207, to make it easier to remove the reservoir 107 off the device 100 and/or lid 202 off the reservoir 107. In the illustrated example, tab 207 is an extension of the ribs on the top of the lid 202, which can assist in placing/removing the final dispense reservoir if it is top-loaded. However, this is not a limitation of the invention, as the final dispense reservoir can be side-loaded or loaded in a different way. Therefore, these tabs or other holding means may be located at other parts of the reservoir, or not be provided at all as the reservoir can be pulled out by direct holding the chamber 201/lid 202, reservoir 107 itself.

The lid 202 can include a cavity 206 adapted to receive the attachment assembly 204 and/or sealing mechanism 203. In this way, the lid can be removed and placed in the dishwasher, for example, while keeping any electromechanical component separate. Cavity 206 can be designed to allow for a full range of the sealing mechanism. Alternatively, or in combination, cavity 206 can be designed to be narrow enough for the sealing mechanism to stay intact with the rest of the assembly as the lid is removed. For example, for a sealing mechanism which is a plunger of a solenoid valve, cavity 206 could prevent the plunger and accompanying spring from falling out of the solenoid body as the lid 202 is removed.

In specific embodiments of the invention, the final dispense reservoir 107 can be gravity-fed and be configured to release the fluid mixture once all components of the fluid mixture have been collected inside of the chamber. As illustrated in FIGS. 2B and 2C, the chamber 201 has a bottom 200. In specific embodiments of the invention, the bottom 200 of the chamber is sloped. In specific embodiments of the invention and as illustrated in the view of FIG. 2C, the bottom 200 of the chamber is continuously sloped towards a lowest point of the chamber 201. In specific embodiments of the invention and as also illustrated in FIG. 2C, the spout 205 can be at the lowest point of the chamber 201. This configuration can contribute to minimizing carryover in that the fluid mixture can naturally flow to the spout as a result of the sloped bottom being sloped towards the lowest point where the spout is located.

The sloped bottom can be sloped at various angles as determined by a device manufacturer. However, in specific embodiments of the invention it can be advantageous to provide a sloped bottom at an angle that minimizes carryover while contributing to a desired flow rate. A slope near flat may result in residues of the fluid mixture remaining in the chamber in more than an acceptable amount. On the other hand, a slope too high may result in the fluid mixture being dispensed out of the chamber at a higher speed than required for a laminar flow (for example because a fluid height in the chamber may be too high, as will be explained in more detail in this disclosure below). Additionally, the slope could also impact the internal capacity of the reservoir (for example, an excessively steep slope could result in a reduced internal capacity). In specific embodiments of the invention, a tilt of 15.5 degrees can be the minimum angle for droplets to slide down to the exit path. Therefore, in those embodiments, the bottom 200 can be continuously sloped towards the lowest point of the chamber at greater than 15.5 degrees.

In specific embodiments of the invention, the material of the chamber, or at least the material of the bottom of the chamber, can be selected so that carryover is minimized. In specific embodiments embodiment of the invention, the chamber, or at least the bottom of the chamber, is covered with a surface coating of a material that minimizes carryover. The material can be selected by analyzing fluid characteristics such as a water contact angle of the material. In specific embodiments of the invention, the material can be selected so that it has a room temperature liquid water contact angle of greater than 90-degrees. In specific embodiments of the invention, a polyurethane coated surface can be used in the chamber, for example to minimize carryover with the minimum 15.5 degrees angle described above. Other polymers can be used, such as polyethylene, polypropylene, etc.

Surface treatment can be performed for reducing carryover, for example to provide a low friction machined finish. In specific embodiments of the invention, the chamber can be of a common, less expensive, material such as a common plastic that is then treated for a surface finish that minimizes carryover. Various considerations can be taken into account when determining the characteristics of this surface, such as what the slide-off angle of this surface is, and what residual liquid stays behind for a given chamber design. Specific embodiments of the invention use a combination (for example combination of liquids and solid textured surfaces to create non-stick surfaces) for surface treatment, finish and/or coating. Some combinations of materials can be used to ensure that the residues in the reservoir are negligible.

Tests result conducted for different surface treatment showed different results. For example, a test conducted with a cast urethane final dispense reservoir with a slope at an angle of 15.5 degrees yielded a carryover of 0.23 g of water for a fluid volume of around 473 mL. Therefore, in specific embodiments of the invention, the reservoir has less than 1 g of liquid water carryover at room temperature. In other specific embodiments of the invention, the reservoir has less than 0.3 g of liquid water carryover at room temperature. As evidenced from the examples above, both the slope and the material of the bottom of the chamber can be optimized so that carryover is minimized.

Figure 3:
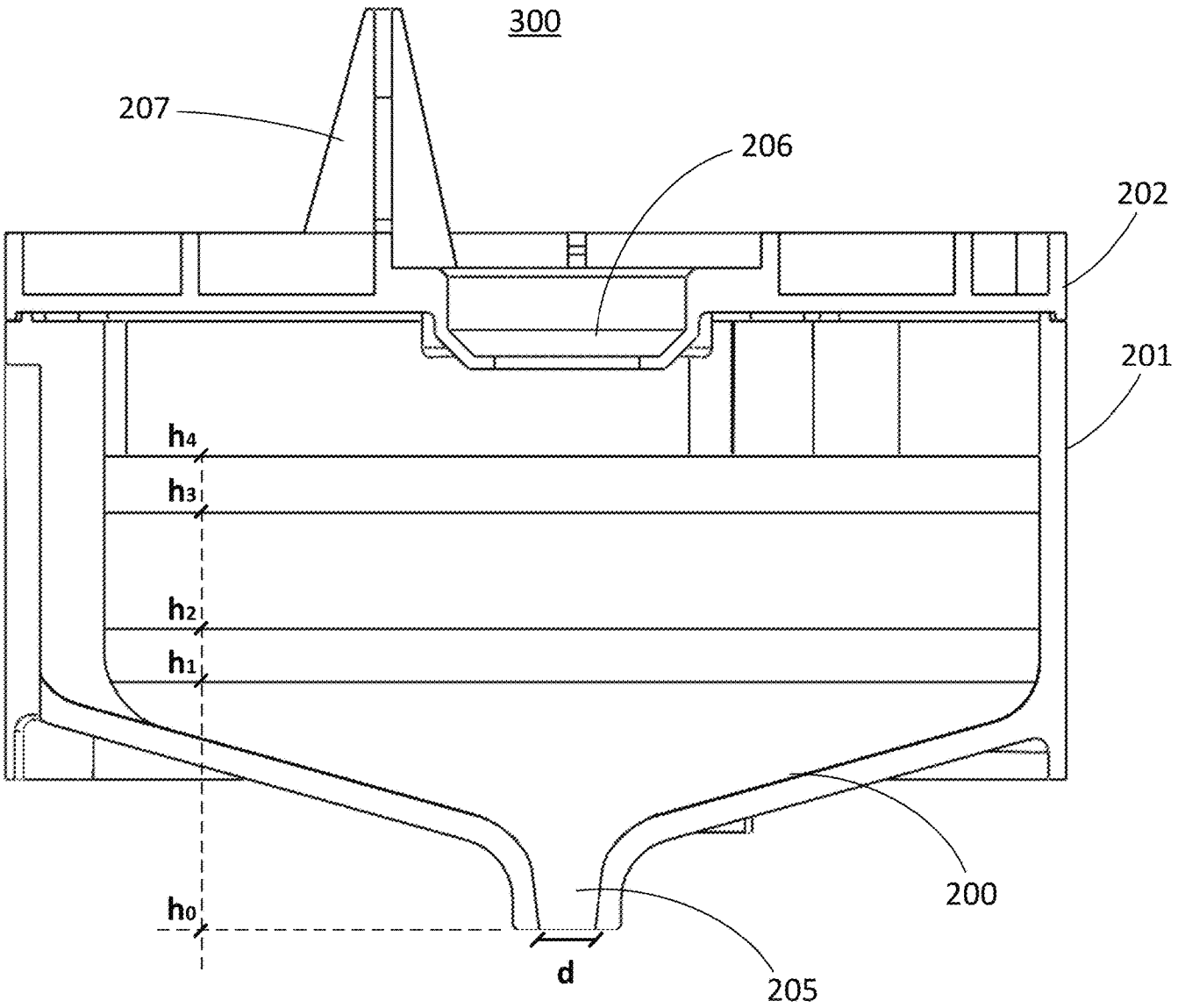
FIG. 3 illustrates a sectional view of a final dispense reservoir, in accordance with specific embodiments disclosed herein.

In specific embodiments of the invention and as will be explained with reference to FIG. 3, not only the carryover but also the characteristics of the flow out of the final dispense reservoirs may be adjusted based on the design of the final dispense reservoir. FIG. 3 includes a sectional view 300 of the final dispense reservoir 107 which illustrates the sloped bottom 200 of the chamber 201 sloped towards a lowest point of the chamber, at height $h_0$. FIG. 3 also shows four different examples of liquid volumes in the chamber 201, each reaching a respective height $h_1$, $h_2$, $h_3$ and $h_4$ with respect to the lowest point at $h_0$.

In specific embodiments of the invention, the volumetric flow rate that results from opening the outlet (e.g., spout 205) can be a function of fluid height in the chamber 201 (e.g., $h_1$, $h_2$, $h_3$ and $h_4$). In this way, the design of the chamber can directly impact such volumetric flow rate. A steeper bottom could cause a given liquid volume in the chamber to reach a higher height, which could directly impact the characteristics of the flow as it impacts the liquid pressure towards the spout, as will be explained below in more detail. In this way, in specific embodiments of the invention, the carryover considerations presented above in this disclosure can be consolidated with the flow rate characterization that will be explained below, to determine an optimized design for the chamber which both minimizes carryover and produces a laminar flow.

In specific embodiments of the invention, the volumetric flow rate that results from opening the outlet (e.g., spout 205) can also be a function of the cross-sectional area of the narrowest point of a fluid path. In the example of FIG. 3, the smallest opening in the fluid path is given by the opening of the spout 205, which has a diameter "d". In specific embodiments of the invention, the spout has a diameter of less than 10 mm. For example, the diameter of the spout could be approximately 6.35 mm. In specific embodiments, the final dispense reservoir can be configured to produce a laminar flow of room temperature liquid water out of the spout at a speed of over 1 liter per minute.

In specific embodiments of the invention, the shape of the chamber can be selected to fit one or more desired fluid mixture volumes and maintain a minimum slope for reducing carryover. Additionally, the shape of the chamber and the size of the spout can be selected in a manner which balances a desirable increase in speed of the dispense with the goal of maintaining a laminar flow of the dispense. In specific embodiments, the balancing of increased speed while maintaining laminar flow must be considered for multiple potential heights of the fluid mixture in the chamber based on multiple potential fluid mixture volumes that must be dispensed. Using the principles disclosed herein a given height can be used to solve for a desired spout diameter and/or a selected spout diameter can be used to return a maximum allowable height. Such functions can be used in combination with a set of constraints set by one or more liquid volumes that must be dispensed from the chamber, a profile of the device in which the chamber will be utilized (e.g., a front facing area of the device), and the above-mentioned desire to minimize carryover, to design an overall shape for the chamber.

In specific embodiments of the invention, the volumetric flow rate out of a final dispense reservoir can be derived from Bernoulli's principle as follows:

$$Q_{disp}=A_{disp}*\sqrt{(2*g*h_{fluid})}$$

Where:

$Q_{disp}$ is the volumetric fluid rate;

$A_{disp}$ is the area of smallest opening in the fluid path (e.g., using diameter "d" in FIG. 3);

g is the gravitational constant; and $h_{fluid}$ is the fluid height in the chamber (e.g., $h_1$, $h_2$, $h_3$ and $h_4$ in FIG. 3).

In specific embodiments of the invention, the final dispense reservoir 107 can be shaped so that it produces a laminar flow through spout 205. In the art of fluid dynamics, the Reynolds number (Re) can be used to determine if a flow falls under a laminar or turbulent regime. A flow can be said to be laminar when the Reynolds number is up to 2300 (Re<2300). However, when the Reynolds number is in a transient zone of flow from approximately 2300 to 4000 either turbulent or laminar flow is possible based on additional fluid dynamic factors that are not modeled by the Reynolds number equations. The Reynolds number can be found using the following equation:

$$Re=(u_{disp}*D_{disp})/nu_{fluid}$$

Where:

Re is the Reynolds number;

$u_{disp}$ is the velocity of the fluid (m/s);

$D_{disp}$ is the hydraulic diameter (e.g., diameter of the opening in the fluid path) (m); and $nu_{fluid}$ is the kinematic viscosity of the fluid ($m^2/s$).

In specific embodiments of the invention, it can be assumed that that most of the fluid mixtures will have a kinematic viscosity ($nu_{fluid}$) similar to water (around 1 $mm^2/s$ at room temperature). In specific embodiments of the invention, fluid mixtures are dispensed at a temperature of 10 degrees C. or below, and the kinematic viscosity ($nu_{fluid}$) of water can be of around 1.3 $mm^2/s$ or higher. The velocity of the fluid ($u_{disp}$) can be determined based on the height of the fluid in the chamber relative to the opening (e.g., spout 205). In this way, a final dispense reservoir and dispense opening can be designed such that a maximum fluid height can produce a laminar flow through the final dispense.

FIG. 3 includes four examples for different fluid volumes that can be held by reservoirs such as reservoir 107, and the respective heights ($h_1$, $h_2$, $h_3$ and $h_4$) that the fluid would reach from the lowest point ($h_0$) of the chamber. The different heights of the illustrated case represent the heights that result from the chamber holding the different desired fluid mixture volumes to be dispensed from the device. For purposes of controlling the flow from spout 205 such that it flows laminarly, the maximum height is the value that is considered and kept under a certain height which is set by the characteristics of the fluid and the diameter of spout 205. The table below includes examples of the maximum height (Fluid Height) that would be reached by exemplary liquid volumes (Fluid Volume) in the final dispense reservoir illustrated in FIG. 3. With a fixed spout diameter, the chamber is shaped such that the largest height stays below a given level to prevent turbulent flow. In the illustrated case, the final dispense reservoir is designed to accommodate a 473 ml fluid volume and has a spout diameter of 6.35 mm. Under these conditions, a laminar flow has been observed for liquid heights of 45 mm and below. Those of ordinary skill in the art will recognize that the Reynolds number for $h_4$ in this configuration exceeds 2300. However, it has been determined empirically that this configuration still produces a laminar flow, as the Reynolds number is in the transient zone of flow mentioned above. Alternatively, the spout diameter can be optimized for a given height as will be explained below in more detail. Different devices can hold different volumes and the examples below are to illustrate the principle of shaping the chamber so that the liquid height characterizes the flow, and not to serve as a limitation of the invention.

| Fluid Volume (ml) | Fluid Height (mm) | Practical Example Height (mm) |
|---|---|---|
| 473 | <45 | 40.715 |
| 355 | <40 | 34.046 |
| 150 | <25 | 21.105 |
| 75 | <20 | 15.055 |

The design of the chamber can likewise be optimized by solving for the diameter of the spout. For example, a specific spout diameter can be determined for a desired flow rate (or to produce a closely laminar flow, to balance laminar flow and flow rate) based on a fluid height in the chamber. The following is a numeric non-limiting example to show the use of the equations described above to optimize the design of the final dispense reservoir. Considering a chamber with a maximum fluid volume at a given time of 355 mL, such fluid volume reaching a height of 58.82 mm in the chamber, which can result in a jet velocity, or mean fluid velocity, of 1073.72 mm/s. For an exemplary temperature of 5 degrees C. for the fluid mixture, the kinematic viscosity of water at this temperature can be assumed (around 1.5 $mm^2$). Therefore, for a Reynolds number <2300, the diameter of the smallest opening in the fluid path can be <3.32 mm. Given this diameter, a starting flow rate for maximum dispense can be around 9.29 mL/s, and the time to pour can be approximately 40 seconds, given the diminishing height and resulting flow rate. As another numeric non-limiting example, a fluid volume in the chamber of 150 mL could reach around 43.17 mm, which would then result in a maximum opening of 3.87 mm. Furthermore, taking into consideration that laminar flow can still be realized in the transient zone mentioned above, laminar flow in chambers having the characteristics described herein can produce a laminar flow with spouts having diameters of less than 10 mm with liquid height as high as 45 mm.

As explained above, the design of the final dispense reservoir can be optimized in various ways to both minimize carryover and produce a laminar flow. The design considerations can take into account the slope in the bottom of the reservoir that minimizes carryover, and that also causes a liquid volume in the chamber to reach a certain height that would produce the laminar flow. At the same time, the diameter of the spout can be considered not only for the provision of the laminar flow but to regulate the flow rate through the spout given the volume and height in the chamber.

The equations given above in this disclosure can be used to optimize the design based on known or assumed factors. As illustrated in the examples above, water was used as a reference fluid to set the values for some of the factors used in such equations (e.g., kinematic viscosity). However, those factors can be adjusted based on the characteristics of the specific type of fluid to be dispensed. In any case, the height of a fluid volume in the chamber and the diameter of the opening that constitutes the hydraulic diameter (e.g., spout 205) are variables that can be calibrated for the desired outcome. As illustrated in the various examples above, in specific embodiments of the invention the design can be based on a height in the chamber, and return a spout diameter, or based on a spout diameter, and return a maximum height (for example via the jet, or mean, velocity in both cases). Using the teachings provided above it is possible to design a fluid mixture dispensing device with a reservoir shaped so that room temperature liquid water will flow laminarly out of the spout even when the reservoir is filled with 400 ml of fluid (and thereby the liquid height is high because the bottom of the chamber is continually sloped and/or the chamber is constrained by the shape of the device in which it must be installed). Those of ordinary skill in the art will recognize that the same effect, of laminar flow, could also be achieved using the same principles if the maximum liquid volume of the chamber was less than 400 ml. In specific embodiments, the spout could have a diameter of less than 10 mm and the chamber could be shaped so that when a fluid mixture is held in the chamber ready to be dispensed (e.g., a final dispense volume of a fluid mixture) the liquid height in the chamber is less than 45 mm. For example, the liquid volume in the chamber could be 150 ml and the liquid height could be less than 45 mm.

As explained with reference to FIG. 2B, the final dispense reservoir 107 can include a sealing mechanism 203 for the spout. As explained, the sealing mechanism can be stopper that is lifted so that the fluid mixture can flow out of the chamber. The design could press down the stopper of an actuator (such as a plunger of a solenoid) to plug the output of the final dispense reservoir and lift the stopper when it is time to dispense. This type of design can be easier to remove for cleaning or servicing purposes as it can be lifted from the top of the reservoir. This kind of sealing mechanism can be also advantageous for minimizing carryover when compared to a valve structure used in most prior art implementations, as more traditional valves for controlling fluid mixture dispensing can present crevices or other structural passages where residue can remain. The material of the sealing mechanisms can be selected so that it is similar to that of the chamber in that the water angle or slide-off angle is optimized for minimal carryover. For example, the stopper can be made of a material with a room temperature liquid water contact angle of greater than 90-degrees.

Figure 4:
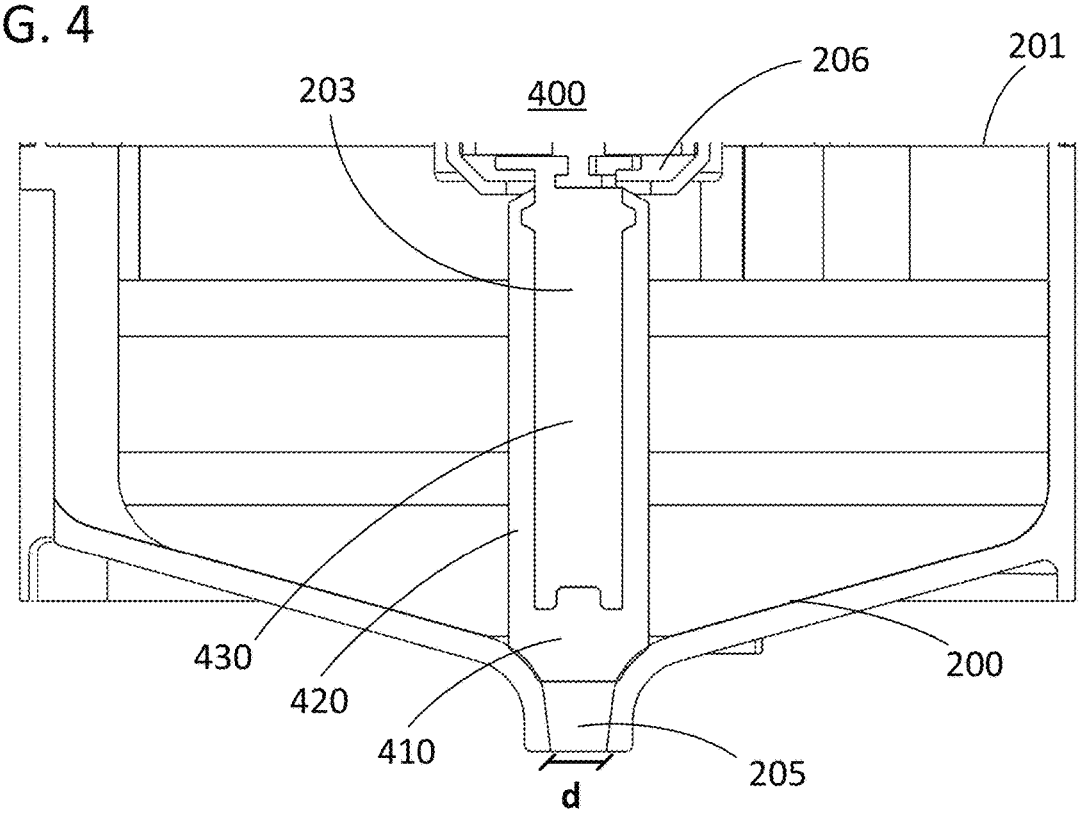
FIG. 4 illustrates an example of the operation of a sealing mechanism for the final dispense reservoir, in accordance with specific embodiments disclosed herein.
Figure 4:
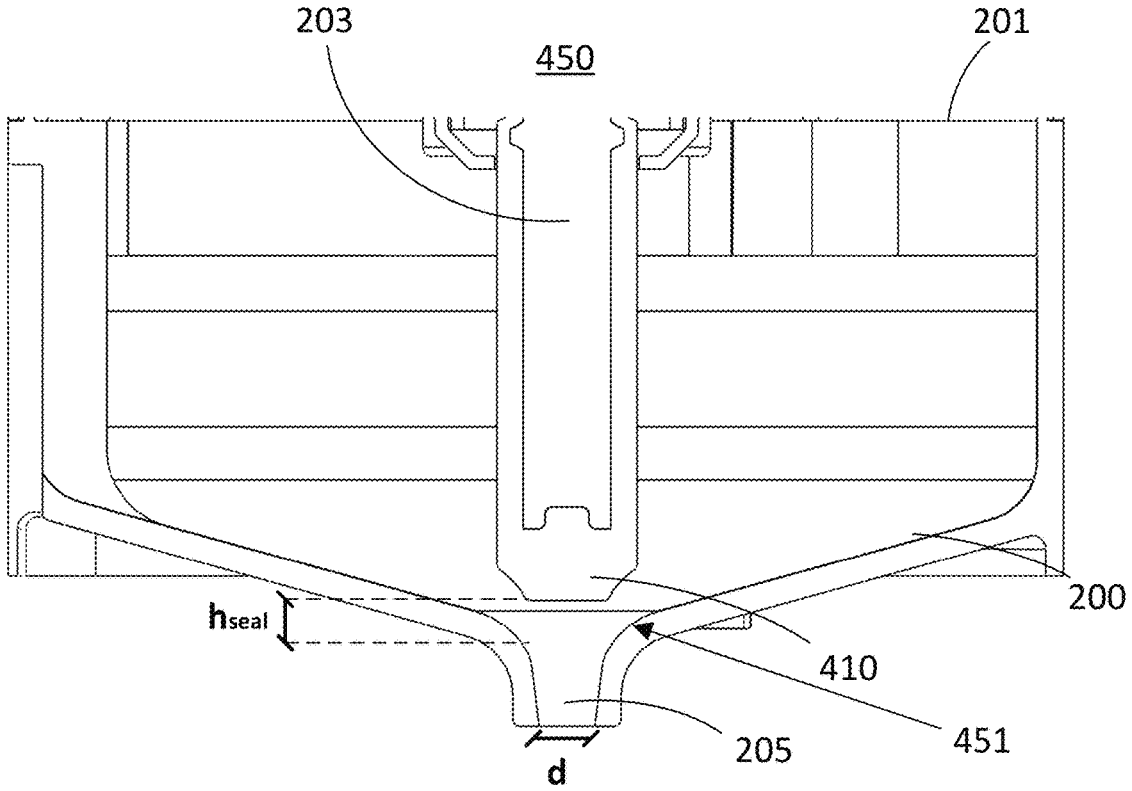

FIG. 4 illustrates an example of the operation of the sealing mechanism 203. View 400 is a sectional view of the final dispense reservoir which shows the sealing mechanism 203 in a closed configuration (i.e., sealing the spout 205). View 450 is a sectional view of the final dispense reservoir which shows the sealing mechanism 203 in an open configuration (i.e., upwardly actuated so that the spout 205 is unsealed). In specific embodiments of the invention, the sealing mechanism has a body 430 and a head 410 that seals the spout. The head can be part of a cover 420 of the body 430. The body 430 can be of a harder material and provide the actuation to the sealing mechanism, while the cover 420 and/or head can be of a softer or more flexible material to provide a snug fit when pressed against the spout 205, for example the cover can be a silicone cover. In specific embodiments of the invention, the head is of a material with a Shore A hardness of less than 50 Shore A. In specific embodiments of the invention, the head is of a material with a Shore A hardness of 30 Shore A. The head can have various shapes to ensure a seal of the chamber, such as straight chamfer or rounded shape.

As explained with reference to FIG. 2B, the sealing mechanism can be attached to the lid of the reservoir and be upwardly actuated by an actuator located on the lid or anywhere else. As represented in FIG. 4, the actuator can lift the sealing mechanism 203 to a height ($h_{seal}$) to allow fluid to flow through the spout 205. As explained before in this disclosure, certain considerations for the optimization in the reservoir's design use the diameter and/or area of the smallest orifice in the fluid path. Therefore, in specific embodiments of the invention, the plunger has a movement range which is at least equal to the minimum diameter "d" of the spout. In this way, the head of the sealing mechanism can be lifted to a height which allows fluid to flow through a path which is at least as wide as the diameter (d) of the spout, so that the flow can still be characterized by the dimensions of the spout 205, and the height to which the sealing mechanism is lifted do not interfere in the fluid flow calculations. For example, in the illustrated approach, the height $h_{seal}$ is large enough to create a distance "d" between point 451 and head 410

Figure 5:
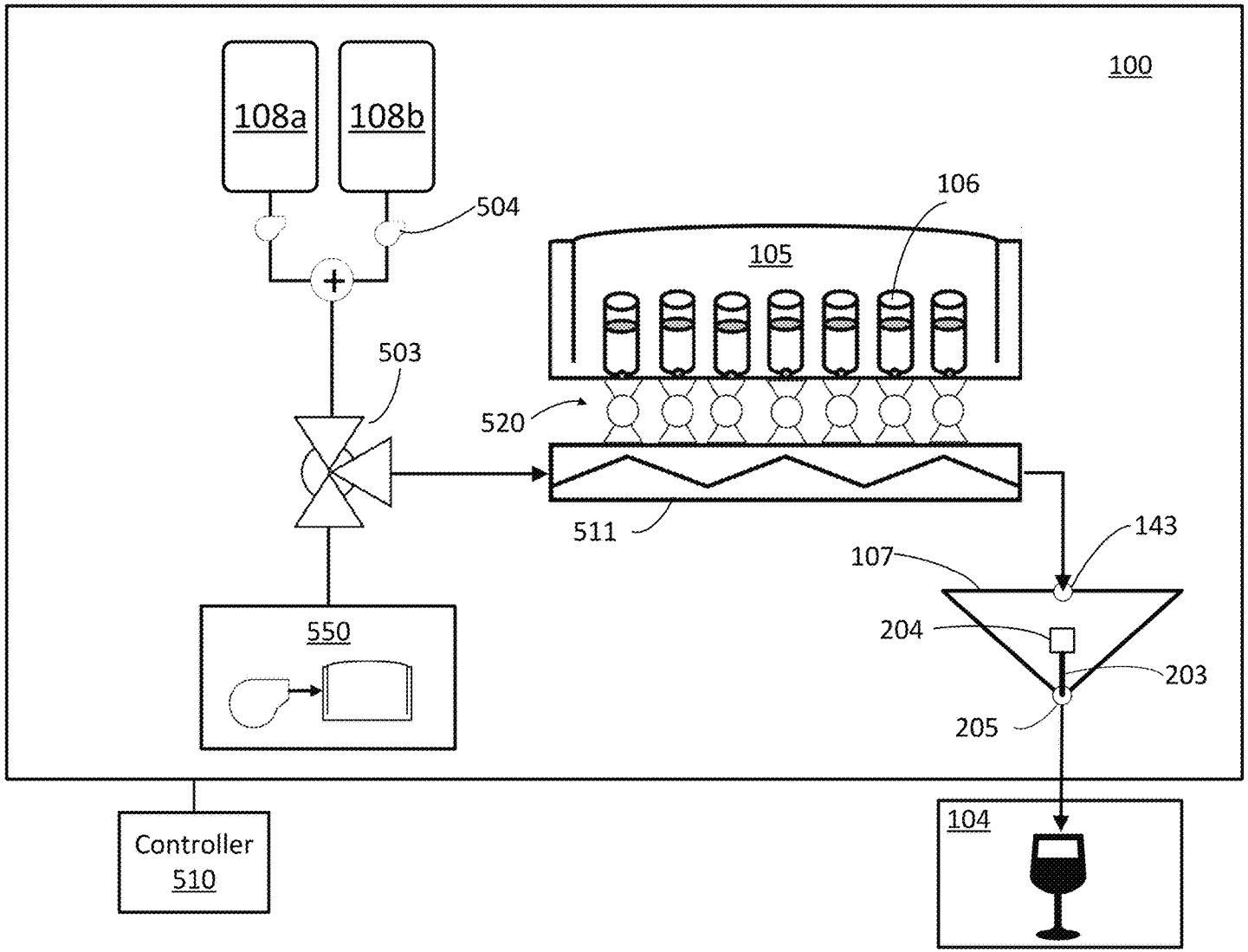
FIG. 5 illustrates a block diagram that includes exemplary components of a fluid mixture dispensing device, in accordance with specific embodiments disclosed herein.

FIG. 5 illustrates a block diagram that includes some exemplary components of a device such as device 100. The block diagram illustrates the solvent reservoirs 108*a* and 108*b* and a set of ingredient reservoirs 106 in a cartridge 105. The solvents and ingredients can be moved to a mixing area 511 of the device via one or more pumps, such as pumps 504, and/or one or more valves, such as valves 520 and 503. A controller, such as controller 510, can have knowledge of the amount of each ingredient(s) and/or solvent(s) needed fora specific fluid mixture and actuate the corresponding pumps and/or valves accordingly. The ingredient(s) and/or solvent(s) can flow from the mixing area 511 to the final dispense reservoir 107, from where the fluid mixture can be dispensed out of the device and to a dispense area 104. A pneumatic system 550 can be used to move the mixture throughout the mixing area and to the final dispense reservoir. The pneumatic system 550 can be any of the pneumatic systems described in U.S. Provisional Patent Application No. 63/146,461 filed Feb. 5, 2021 and U.S. patent application Ser. No. 17/548,258 filed Dec. 10, 2021, all of which are incorporated by reference herein in their entirety for all purposes. The controller can also control the actuator of the sealing mechanism 203, so that the spout 205 is unsealed when the fluid mixture is ready for dispense.

A controller, as used in this disclosure for example with reference to controller 510, can include one or more processors that can be distributed locally within the system or remotely. For example, one or more components of the system, such as valves, pumps, and sensors can be associated to individual microcontrollers that can control their operations and interaction with other components of the system. In specific embodiments of the invention, the controller can be a control system for the overall device even if the various control elements are separately programmed and are not part of a common control hierarchy. The controller can have access to one or more memories that store the instructions for the controllers. The memories can also store information for the system, such as a library of recipes, reference values such as the pressure thresholds and/or target pressure values mentioned in this disclosure, and any other necessary information such as sensor data and the like.

While the specification has been described in detail with respect to specific embodiments of the invention, it will be appreciated that those skilled in the art, upon attaining an understanding of the foregoing, may readily conceive of alterations to, variations of, and equivalents to these embodiments. Any of the method disclosed herein can be executed by a processor in combination with a computer readable media storing instructions for the methods in combination with the other hardware elements described above. These and other modifications and variations to the present invention may be practiced by those skilled in the art, without departing from the scope of the present invention, which is more particularly set forth in the appended claims.

What is claimed is:

1. A reservoir for a fluid mixture dispensing device, the reservoir comprising:

a chamber with at least one inlet for receiving a liquid ingredient;

a bottom of the chamber, wherein the bottom is continuously sloped towards a lowest point of the chamber; and a spout at the lowest point of the chamber having a diameter of less than 10 mm;

wherein the chamber is shaped so that when a liquid volume in the chamber is 150 ml, a liquid height in the chamber is less than 45 mm;

the bottom is continuously sloped towards the lowest point of the chamber at treater than or equal to 15.5 degrees;

the reservoir has less than 0.3 g of liquid water carryover at room temperature;

the reservoir has at least one of a material with a room temperature liquid water contact angle of greater than 90-degrees, and a material with a surface treatment with a room temperature liquid water contact angle of greater than 90-degrees.

2. The reservoir of claim 1, wherein:

the reservoir is configured to produce a laminar flow of room temperature liquid water out of the spout at a speed of over 1 liter per minute.

3. The reservoir of claim 1, wherein:

the chamber is configured to receive, via the at least one inlet, a set of ingredients to create a fluid mixture; and the liquid volume and the liquid height are a respective volume and height of the fluid mixture in the chamber.

4. The reservoir of claim 1, further comprising:

an electromechanical actuator; and a plunger;

wherein the electromechanical actuator actuates the plunger to alternatively seal and unseal the spout of the chamber.

5. The reservoir of claim 1, wherein the chamber is configured to:

passively mix a set of ingredients to form a fluid mixture when the spout is sealed; and dispense the fluid mixture out of the fluid mixture dispensing device when the spout is unsealed.

6. The reservoir of claim 1, wherein:

the bottom has a coated surface; and the coated surface has a room temperature liquid water contact angle of greater than 90-degrees.

7. The reservoir of claim 1, wherein:

the reservoir includes a detachable portion;

the detachable portion is detachable from the fluid mixture dispensing device; and the detachable portion is dishwasher safe.

8. The reservoir of claim 1, further comprising:

a lid of the reservoir; and a sealing mechanism for the spout;

wherein the sealing mechanism is attached to the lid of the reservoir.

9. The reservoir of claim 8, wherein:

the sealing mechanism includes a plunger of an electromechanical valve; and the sealing mechanism is attached to the lid of the reservoir via the electromechanical valve.

10. The reservoir of claim 8, wherein:

the sealing mechanism is detachably attached to the lid; and the lid is detachably attached to the reservoir.

11. The reservoir of claim 1, further comprising:

a lid of the reservoir;

wherein the chamber is detachably attached to the fluid mixture dispensing device via the lid; and wherein the lid remains attached to the fluid mixture dispensing device when the chamber is detached.

12. A fluid mixture dispensing device comprising:

a controller programmed to actuate a set of valves and at least one pump to dispense a fluid mixture, having a final dispense volume, from the fluid mixture dispensing device; and a reservoir, the reservoir comprising:

a chamber with at least one inlet for receiving a liquid ingredient;

a bottom of the chamber, wherein the bottom is continuously sloped towards a lowest point of the chamber; and a spout at the lowest point of the chamber having a diameter of less than 10 mm;

wherein the chamber is shaped so that when the fluid mixture having the final dispense volume is in the chamber a liquid height of the fluid mixture in the chamber is less than 45 mm;

the bottom is continuously sloped towards the lowest point of the chamber at greater than or equal to 15.5 degrees;

the reservoir has less than 0.3 g of liquid water carryover at room temperature;

the reservoir has at least one of a material with a room temperature liquid water contact angle of greater than 90-degrees, and a material with a surface treatment with a room temperature liquid water contact angle of greater than 90-degrees.

13. The fluid mixture dispensing device of claim 12, wherein:

the reservoir is configured to produce a laminar flow of room temperature liquid water out of the spout at a speed of over 1 liter per minute.

14. The fluid mixture dispensing device of claim 12, wherein:

the chamber is configured to receive, via the at least one inlet, a set of ingredients to create a fluid mixture; and the liquid height is a height of the fluid mixture in the chamber.

15. The fluid mixture dispensing device of claim 12, further comprising:

an electromechanical actuator; and a plunger;

wherein the electromechanical actuator actuates the plunger to alternatively seal and unseal the spout of the chamber.

16. The fluid mixture dispensing device of claim 12, wherein the chamber is configured to:

passively mix a set of ingredients to form a fluid mixture when the spout is sealed; and dispense the fluid mixture out of the fluid mixture dispensing device when the spout is unsealed.

17. The fluid mixture dispensing device of claim 12, wherein:

the bottom has a coated surface; and the coated surface has a room temperature liquid water contact angle of greater than 90-degrees.

18. The fluid mixture dispensing device of claim 12, wherein:

the reservoir includes a detachable portion;

the detachable portion is detachable from the fluid mixture dispensing device; and the detachable portion is dishwasher safe.

19. The fluid mixture dispensing device of claim 12, further comprising:

a lid of the reservoir; and a sealing mechanism for the spout;

wherein the sealing mechanism is attached to the lid of the reservoir.

20. The fluid mixture dispensing device of claim 19, wherein:

the sealing mechanism includes a plunger of an electromechanical valve; and the sealing mechanism is attached to the lid of the reservoir via the electromechanical valve.

21. The fluid mixture dispensing device of claim 19, wherein:

the sealing mechanism is detachably attached to the lid; and the lid is detachably attached to the reservoir.

22. The fluid mixture dispensing device of claim 12, further comprising:

a lid of the reservoir;

wherein the chamber is detachably attached to the fluid mixture dispensing device via the lid; and wherein the lid remains attached to the fluid mixture dispensing device when the chamber is detached.

23. A reservoir for a fluid mixture dispensing device, the reservoir comprising:

a chamber with at least one inlet for receiving a liquid ingredient;

a bottom of the chamber, wherein the bottom is continuously sloped towards a lowest point of the chamber; and a spout at the lowest point of the chamber;

wherein the chamber is shaped so that room temperature liquid water would flow laminarly out of the spout when a liquid volume in the chamber is: (1) a maximum volume capacity of the chamber; or (ii) 400 ml, whichever is smaller;

the bottom is continuously sloped towards the lowest point of the chamber at greater than or equal to 15.5 degrees;

the reservoir has less than 0.3 g of liquid water carryover at room temperature;

the reservoir has at least one of a material with a room temperature liquid water contact angle of greater than 90-degrees, and a material with a surface treatment with a room temperature liquid water contact angle of greater than 90-degrees.

* * * * *